US011739911B1

(12) United States Patent
Liu

(10) Patent No.: US 11,739,911 B1
(45) Date of Patent: Aug. 29, 2023

(54) PROJECTION DEVICE

(71) Applicant: Lifang Liu, Shenzhen (CN)

(72) Inventor: Lifang Liu, Shenzhen (CN)

( * ) Notice: Subject to any disclaimer, the term of this patent is extended or adjusted under 35 U.S.C. 154(b) by 0 days.

(21) Appl. No.: 17/848,444

(22) Filed: Jun. 24, 2022

Related U.S. Application Data

(63) Continuation-in-part of application No. 17/676,848, filed on Feb. 22, 2022.

(30) Foreign Application Priority Data

Mar. 1, 2022 (CN) ..... 202220441525.9
May 20, 2022 (CN) ..... 202221232370.4

(51) Int. Cl.
*F21V 14/06* (2006.01)
*F21V 5/04* (2006.01)
*F21V 29/70* (2015.01)
*F21V 3/04* (2018.01)
*F21Y 115/10* (2016.01)

(52) U.S. Cl.
CPC ..... *F21V 14/06* (2013.01); *F21V 3/049* (2013.01); *F21V 5/04* (2013.01); *F21V 29/70* (2015.01); *F21Y 2115/10* (2016.08)

(58) Field of Classification Search
CPC ..... G01S 19/42; G01S 19/24; G01S 19/48; G06Q 30/0261; G06Q 30/0207; G06Q 30/0267; H04W 88/02; F21S 10/005; F21S 10/007; F21W 2121/008; G03B 21/14; F21V 14/06; F21V 3/049; F21V 5/04; F21V 29/70; F21Y 2115/10
See application file for complete search history.

(56) References Cited

U.S. PATENT DOCUMENTS 11,041,596 B1 * 6/2021 Zhang ..... F21V 3/049
11,365,856 B1 * 6/2022 Ouyang ..... F21V 5/04
11,454,375 B1 * 9/2022 Xiong ..... G02B 27/0972

FOREIGN PATENT DOCUMENTS

CN 215446403 U * 1/2022 ..... F21S 10/007

* cited by examiner

*Primary Examiner* — Jong-Suk (James) Lee
*Assistant Examiner* — Glenn Zimmerman

(57) ABSTRACT

A projection device includes a first projection assembly. The first projection assembly includes a first light source assembly, a first lens, a driving device, and a light-transmitting lampshade. The first light source assembly includes a first light source configured to generate projection light. The first lens is arranged on a light path of the first light source. A plurality of first irregular plano-convex lenses are arranged on a light exit side of the first lens. The driving device is connected to the first lens. The driving device is configured to drive the first lens to rotate. The light-transmitting lampshade is arranged on the light path of the first light source and is arranged behind the first lens. The projection light generated by the first light source sequentially passes through the first lens and the light-transmitting lampshade and emits externally.

20 Claims, 20 Drawing Sheets

PROJECTION DEVICE

TECHNICAL FIELD

The present disclosure relates to a field of projection lamp technology, and in particular to a projection device.

BACKGROUND

Projection lamps are generally used in some indoor places. The projection lamps adopts the principle of light interference and diffraction to create a starry sky environment, which is conducive to people to relieve fatigue and stress caused by a day of work, and has a good decorative effect.

However, in the prior art, patterns projected by the conventional projection lamps on the market are mostly simple patterns such as stars. A projection effect is monotonous, which is unable to meet requirements of an active atmosphere in many occasions.

SUMMARY

A purpose of the present disclosure is to provide a projection device, which aims to solve a problem of monotonous projection effect of projection devices in the prior art.

The present disclosure provides a projection device. The projection device comprise a first projection assembly. The first projection assembly comprises a first light source assembly, a first lens, a second lens, a light-transmitting lampshade, and a driving device.

The first light source assembly comprises a first light source configured to generate projection light. The first lens is arranged on a light path of the first light source. A plurality of first irregular plano-convex lenses are arranged on a light exit side of the first lens. The second lens is arranged on the light path of the first light source and is arranged behind the first lens. A plurality of second irregular plano-convex lenses are arranged on a light exit side of the second lens. Shapes of the plurality of second irregular plano-convex lenses arranged on the light exit side of the second lens are different from shapes of the plurality of first irregular plano-convex lenses arranged on the light exit side of the first lens. The light-transmitting lampshade is arranged on the light path of the first light source and is arranged behind the second lens. The projection light generated by the first light source sequentially passes through the first lens, the second lens, and the light-transmitting lampshade and emits externally. The driving device is connected to the first lens or the second lens. The driving device is configured to drive the first lens or the second lens to rotate.

Furthermore, the first lens comprises a lens portion and a tooth portion. The plurality of first irregular plano-convex lenses are arranged in the lens portion. Meshing teeth are arranged on the tooth portion. The driving device comprises a motor and a gear directly or indirectly driven by the motor. When the motor drives the gear to rotate, the gear drives the light-transmitting lampshade to rotate through the tooth portion.

Furthermore, the tooth portion is arranged around a periphery of the lens portion and protrudes from an end face of the lens portion. The meshing teeth are arranged on an inner side wall or an outer side wall of the tooth portion.

Furthermore, the driving device comprises a motor and a belt drive assembly connecting the motor and the first lens. The motor drives the first lens to rotate through the belt drive assembly.

Furthermore, the plurality of first irregular plano-convex lenses arranged on the light exit side of the first lens are hill-shaped plano-convex lenses. The plurality of second irregular plano-convex lenses arranged on the light exit side of the second lens are selected from elongated plano-convex lenses, spiral plano-convex lenses, and polygonal plano-convex lenses.

Furthermore, the light-transmitting lampshade is a hollow hemispherical light-transmitting lampshade. Both of an inner surface of the light-transmitting lampshade and an outer surface of the light-transmitting lampshade are smooth curved surfaces. The second lens is fixedly connected to the light-transmitting lampshade.

Furthermore, the projection device further comprises a housing and a mounting frame. The housing defines a lampshade hole. The mounting frame is arranged in the housing. A position of the mounting frame corresponds to a position of the lampshade hole. The first lens and the second lens are mounted in the housing through the mounting frame. The light-transmitting lampshade is arranged at the lampshade hole.

Furthermore, a first step area and a second step area are arranged on one end of the mounting frame close to the lampshade hole. The first step area and the second step area are arranged in sequence along a direction away from a center of the mounting frame. The first lens is arranged on the first step area and the second lens is arranged on the second step area. The first light source is arranged on one side of the first lens away from the second lens. The first light source is deviated from a rotation center of the first lens.

Furthermore, the first light source assembly further comprises a lamp board, a lamp frame, and a light concentrating piece. The lamp board is mounted on the mounting frame; the first light source is an LED lamp bead. The lamp frame is mounted on the lamp board and is arranged on an outside of the LED lamp bead. The light concentrating piece is mounted in the lamp frame. The light concentrating piece is configured to concentrate light emitted from the LED lamp bead.

Furthermore, the projection device further comprises a second projection assembly and a third projection assembly. The second projection assembly comprises a second light source configured to generate laser light, a heat dissipating bracket mounted outside the second light source, and a grating sheet arranged in a laser light exit direction of the second light source. The third projection assembly comprises a third light source, a film with a pattern, a convex lens configured to magnify a projected pattern, and a lens holder configured to mount the film and the convex lens.

The present disclosure further provides a projection device. The projection device comprises a first projection assembly. The first projection assembly comprises a first light source assembly, a first lens, a driving device, and a light-transmitting lampshade. The first light source assembly comprises a first light source configured to generate projection light. The first lens is arranged on a light path of the first light source. A plurality of first irregular plano-convex lenses are arranged on the first lens. The driving device is connected to the first lens. The driving device is configured to drive the first lens to rotate. The light-transmitting lampshade is arranged on the light path of the first light source and is arranged behind the first lens. The projection light generated by the first light source sequentially passes through the first lens and the light-transmitting lampshade and emits externally. The light-transmitting lampshade comprises a plurality of second irregular plano-convex lenses.

Shapes of the plurality of second irregular plano-convex lenses arranged on the light-transmitting lampshade are different from shapes of the plurality of first irregular plano-convex lenses arranged on the first lens.

Furthermore, the plurality of first irregular plano-convex lenses arranged on the first lens are hill-shaped plano-convex lenses. The plurality of second irregular plano-convex lenses are arranged on an inner surface of the light-transmitting lampshade. The plurality of second irregular plano-convex lenses are selected from one or a combination of elongated plano-convex lenses, spiral plano-convex lenses, and polygonal plano-convex lenses.

Furthermore, the first lens comprises a lens portion and a tooth portion. The plurality of first irregular plano-convex lenses are arranged in the lens portion. Meshing teeth are arranged on the tooth portion. The driving device comprises a motor and a gear directly or indirectly driven by the motor. When the motor drives the gear to rotate, the gear drives the light-transmitting lampshade to rotate through the tooth portion.

Furthermore, the tooth portion is arranged around a periphery of the lens portion and protrudes from an end face of the lens portion. The meshing teeth are arranged on an inner side wall or an outer side wall of the tooth portion.

Furthermore, the driving device comprises a motor and a belt drive assembly connecting the motor and the first lens. The motor drives the first lens to rotate through the belt drive assembly.

Furthermore, the projection device further comprises a housing and a mounting frame. The housing defines a lampshade hole. The mounting frame is arranged in the housing. A position of the mounting frame corresponds to a position of the lampshade hole. The first lens and the second lens are mounted in the housing through the mounting frame. The light-transmitting lampshade is arranged at the lampshade hole.

Furthermore, a rotating shaft is arranged on a center of the mounting frame. A shaft hole is on a center of the first lens. The rotating shaft passes through the shaft hole, so the first lens is rotatably connected with the mounting frame.

Furthermore, a step area is arranged on one end of the mounting frame close to the lampshade hole. The first lens is arranged on the step area and the second lens is arranged on the second step area. The first light source is arranged on one side of the first lens away from the light-transmitting lampshade. The first light source is deviated from a rotation center of the first lens.

Furthermore, the first light source assembly further comprises a lamp board, a lamp frame, and a light concentrating piece. The lamp board is mounted on the mounting frame. The first light source is an LED lamp bead. The lamp frame is mounted on the lamp board and is arranged on an outside of the LED lamp bead. The light concentrating piece is mounted in the lamp frame. The light concentrating piece is configured to concentrate light emitted from the LED lamp bead.

Furthermore, the projection device further comprises a second projection assembly and a third projection assembly. The second projection assembly comprises a second light source configured to generate laser light, a heat dissipating bracket mounted outside the second light source, and a grating sheet arranged in a laser light exit direction of the second light source. The third projection assembly comprises a third light source, a film with a pattern, a convex lens configured to magnify a projected pattern, and a lens holder configured to mount the film and the convex lens.

Compared with the prior art, in the present disclosure, the first lens, the second lens, and the light-transmitting lampshade are arranged on the light path of the first light source, the plurality of first irregular plano-convex lenses are arranged on the light exit side of the first lens and the plurality of second irregular plano-convex lenses with different shapes from the first plano-convex lenses are arranged on the light exit side of the first lens, so when the driving device drives the first lens to rotate, not only a dynamic projection effect is generated, but also a variable projection effect is generated. When the light passes through the first lens and the second lens, different shapes of plano-convex lenses on the first lens and the second lens make projection effects superimposed and then the projection light exits from the light-transmitting lampshade to form the variable projection effect.

DETAILED DESCRIPTION

In order to make objectives, technical solutions, and advantages of the present disclosure clearer, the following further describes the present disclosure in detail with reference to accompanying drawings and embodiments. It should be understood that the specific embodiments described here are only used to explain the present disclosure, but not to limit the present disclosure.

It should be noted that in the description of the present disclosure, terms such as "first", "second", and "third" are only used for the purpose of description, rather than being understood to indicate or imply relative importance. In addition, unless otherwise regulated and defined, terms such as "installation," "bonded," and "connection" shall be understood in broad sense, and for example, may refer to fixed connection or detachable connection or integral connection; may refer to mechanical connection or electrical connection; and may refer to direct connection or indirect connection through an intermediate medium or inner communication of two elements. For those of ordinary skill in the art, the meanings of the above terms in the present disclosure may be understood according to concrete conditions.

Embodiment 1

Figure 1:
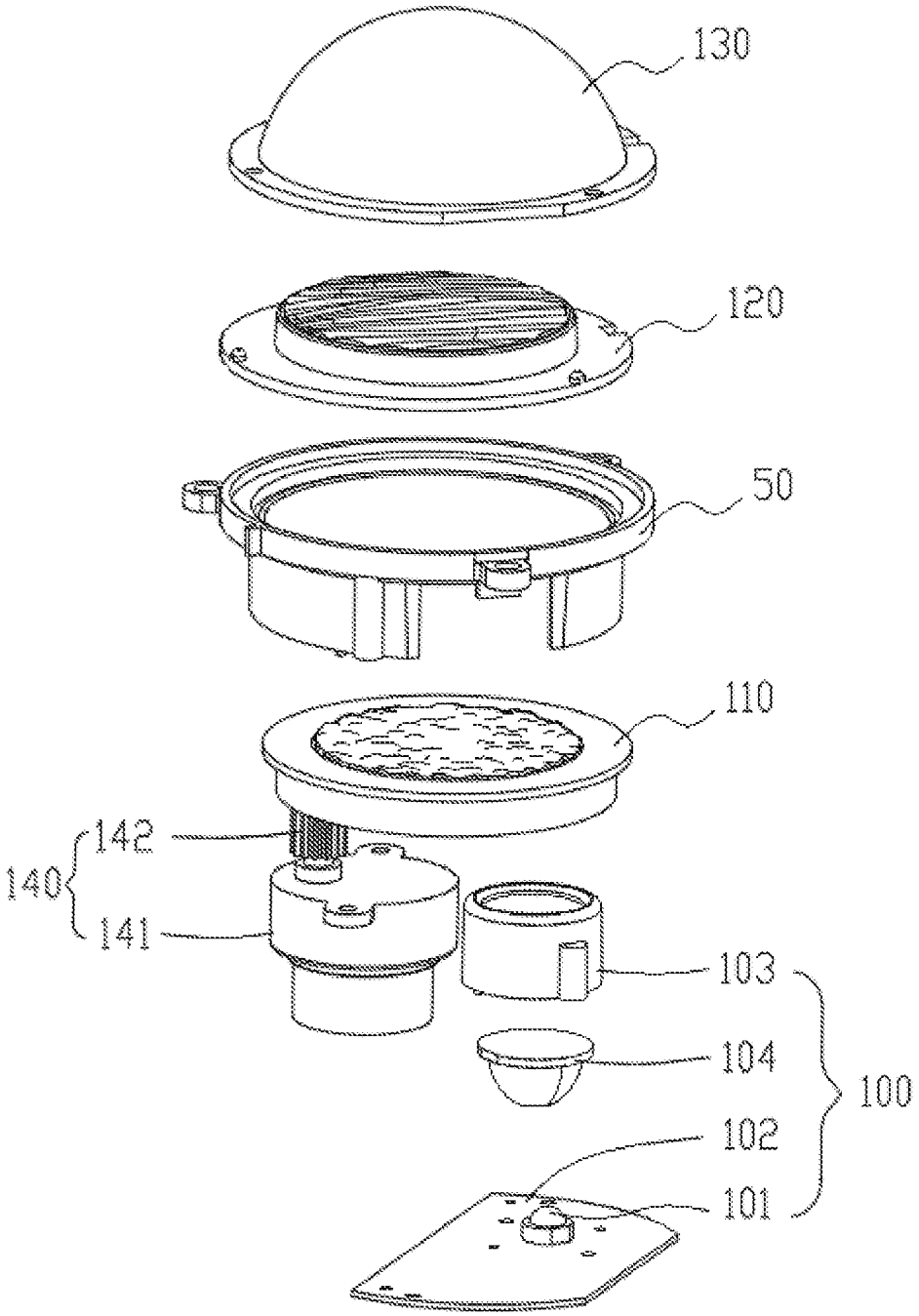
FIG. 1 is an exploded schematic diagram of a first projection assembly of a projection device according to one embodiment of the present disclosure.
Figure 2:
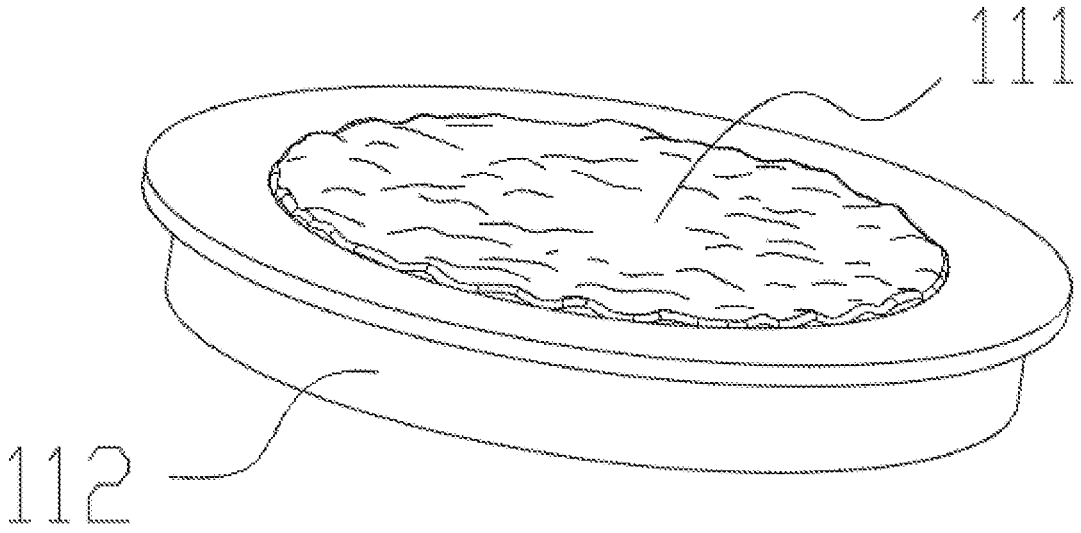
FIG. 2 is a perspective schematic diagram of a first lens according to one embodiment of the present disclosure.
Figure 3:
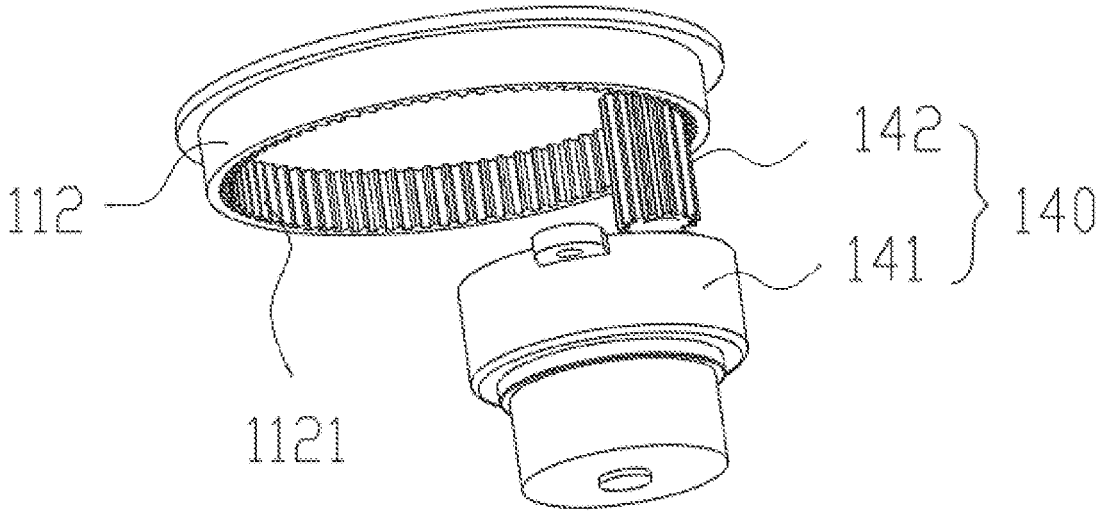
FIG. 3 is a perspective schematic diagram of the first lens and a driving device according to one embodiment of the present disclosure where the first lens is connected with the driving device.
Figure 4:
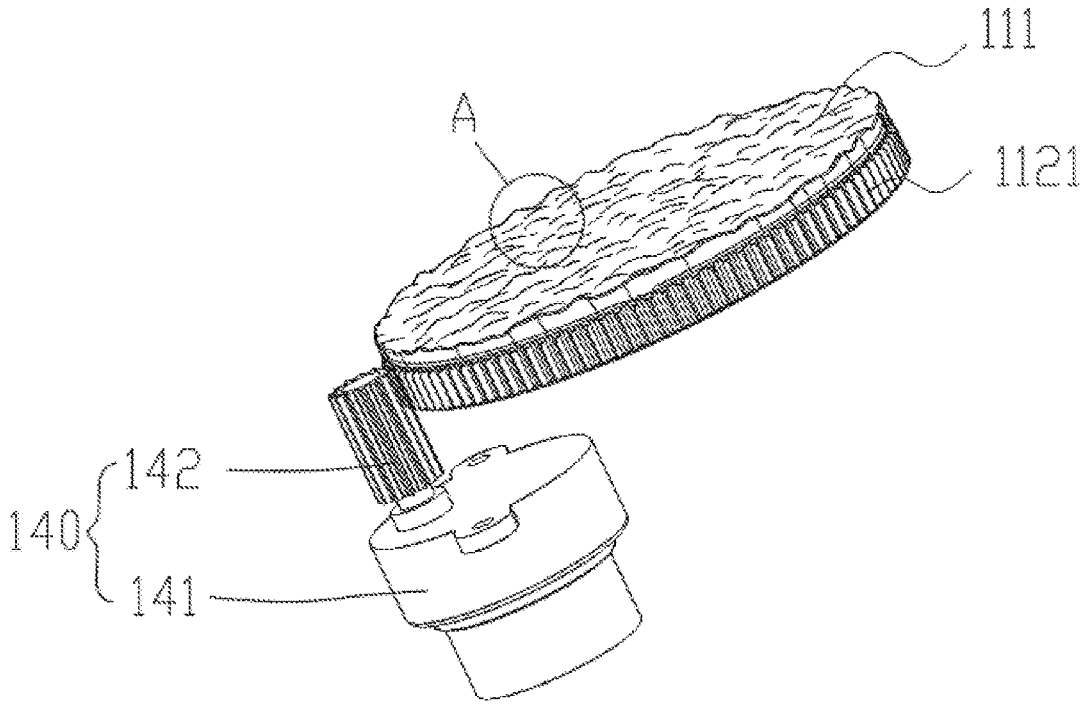
FIG. 4 is a perspective schematic diagram of the first lens and the driving device according to another embodiment of the present disclosure where the first lens is connected with the driving device.
Figure 5:
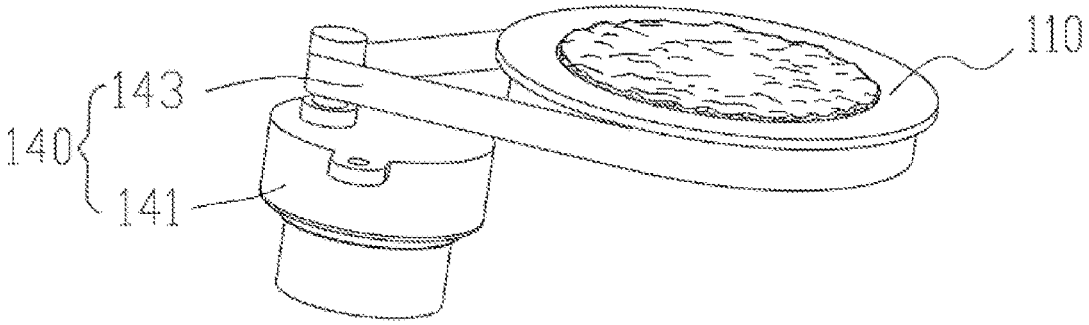
FIG. 5 is a perspective schematic diagram of the first lens and the driving device according to another embodiment of the present disclosure where the first lens is connected with the driving device.
Figure 6:
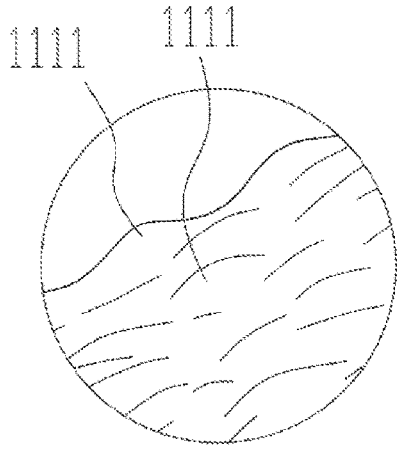
FIG. 6 is an enlarged view of portion A shown in FIG. 4.
Figure 7:
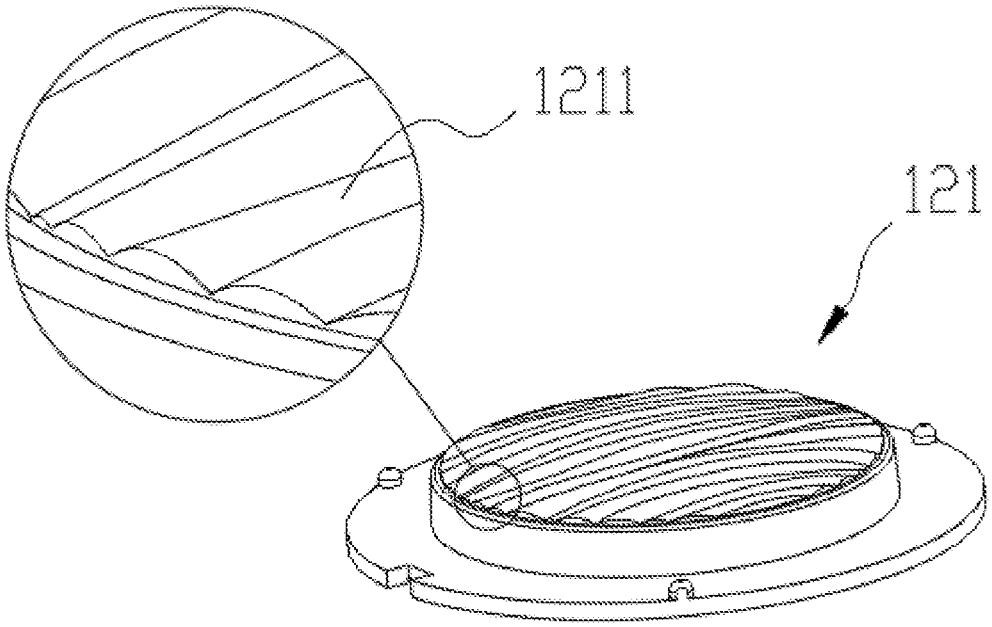
FIG. 7 is a schematic diagram of a second lens provided with protruding elongated plano-convex lenses according to one embodiment of the present disclosure.
Figure 8:
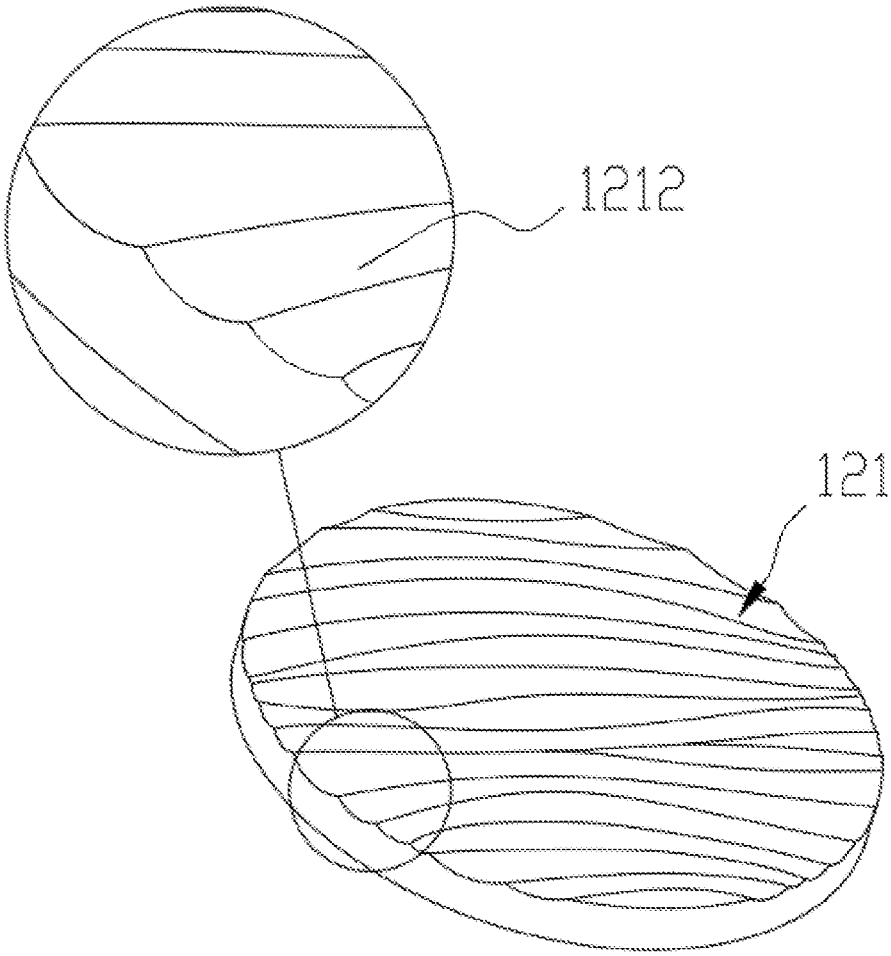
FIG. 8 is a schematic diagram of the second lens provided with concave elongated plano-convex lenses according to one embodiment of the present disclosure.
Figure 9:
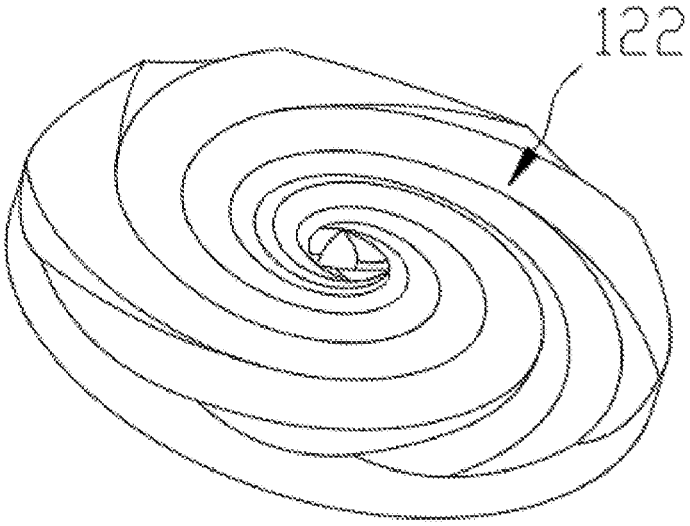
FIG. 9 is a schematic diagram of the second lens provided with spiral plano-convex lenses according to one embodiment of the present disclosure.
Figure 10:
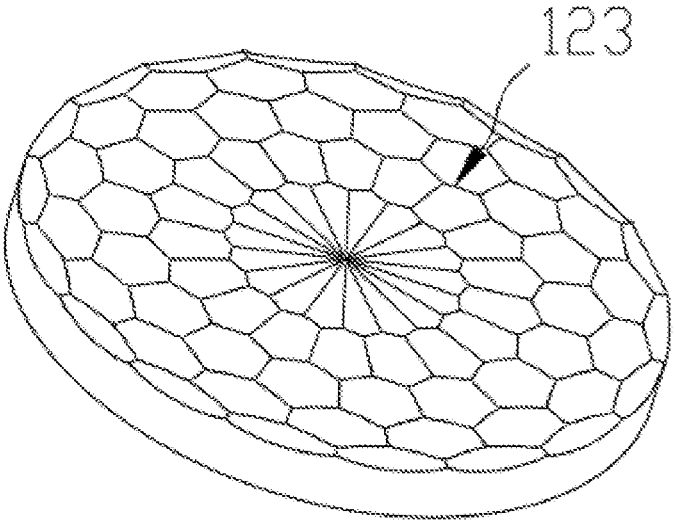
FIG. 10 is a schematic diagram of the second lens provided with polygonal plano-convex lenses according to one embodiment of the present disclosure.
Figure 11:
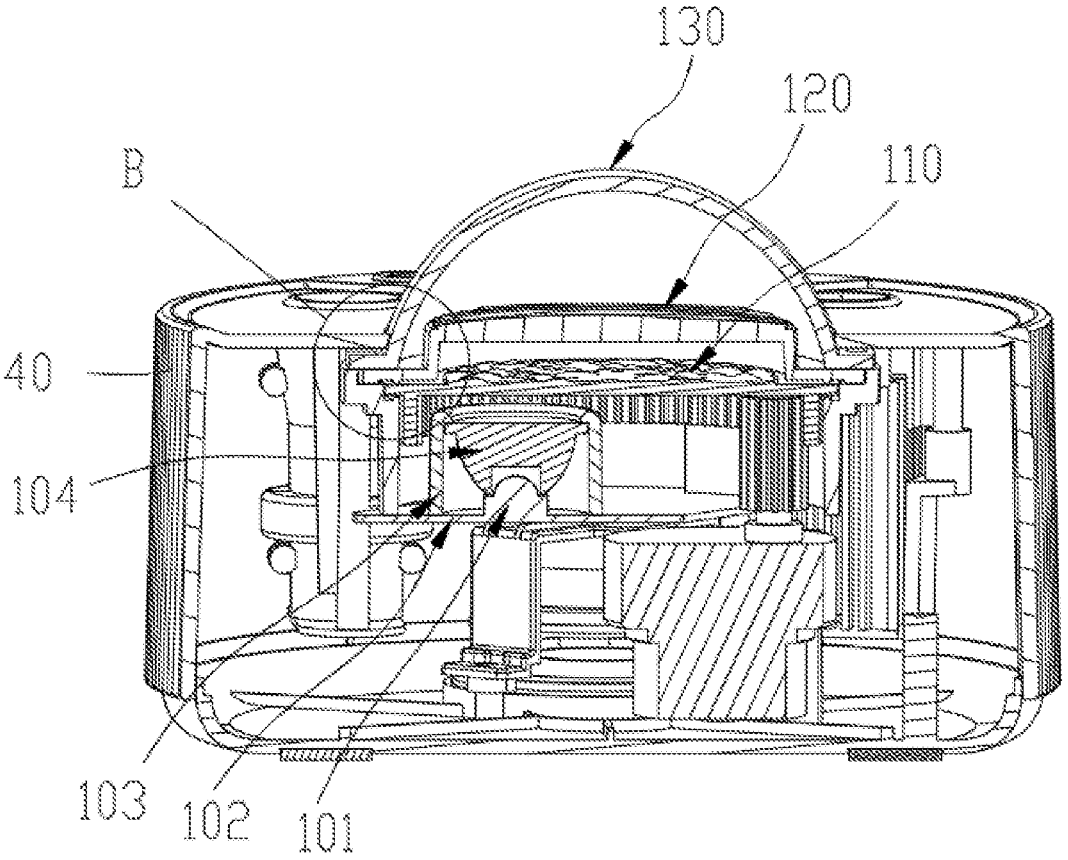
FIG. 11 is a cross-sectional schematic diagram of the projection device according to one embodiment of the present disclosure.
Figure 12:
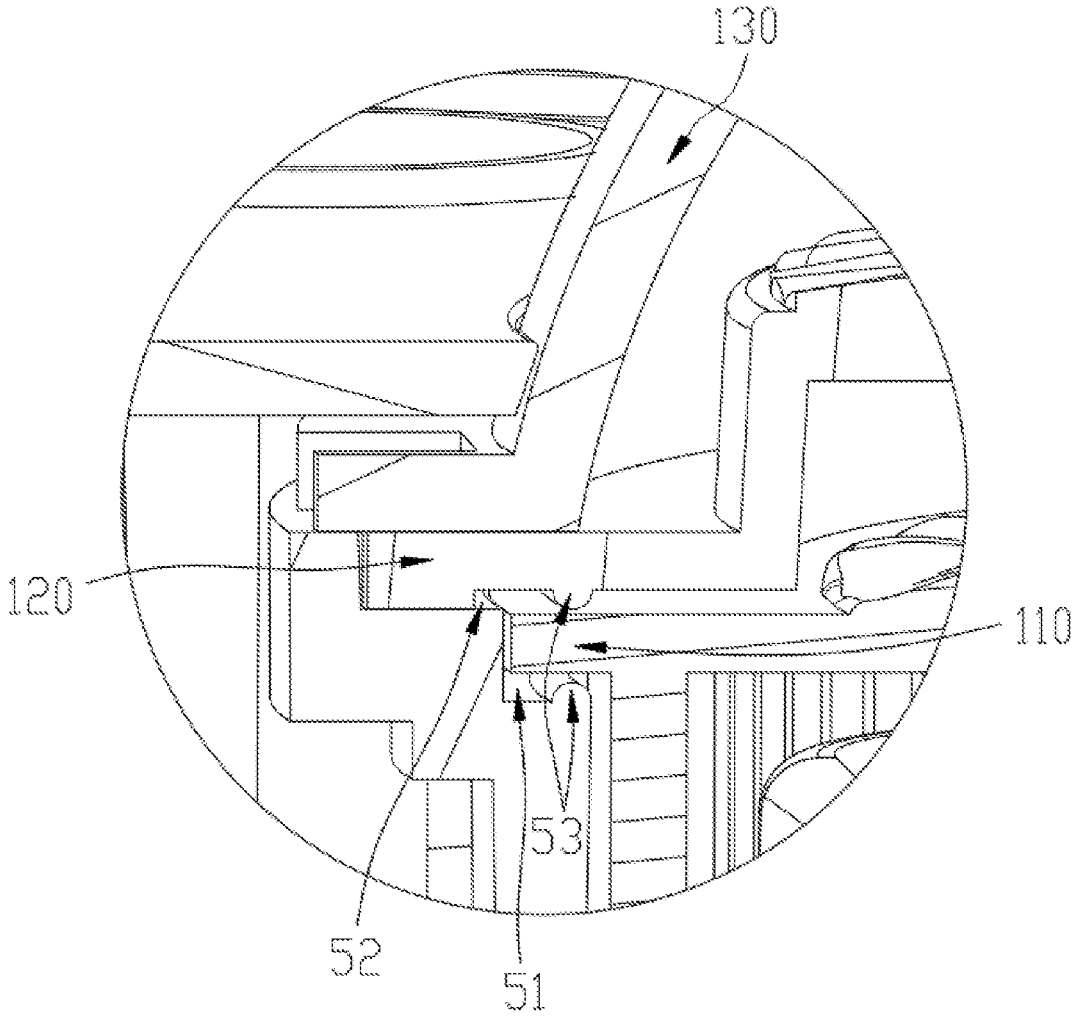
FIG. 12 is an enlarged view of portion B shown in FIG. 11.
Figure 13:
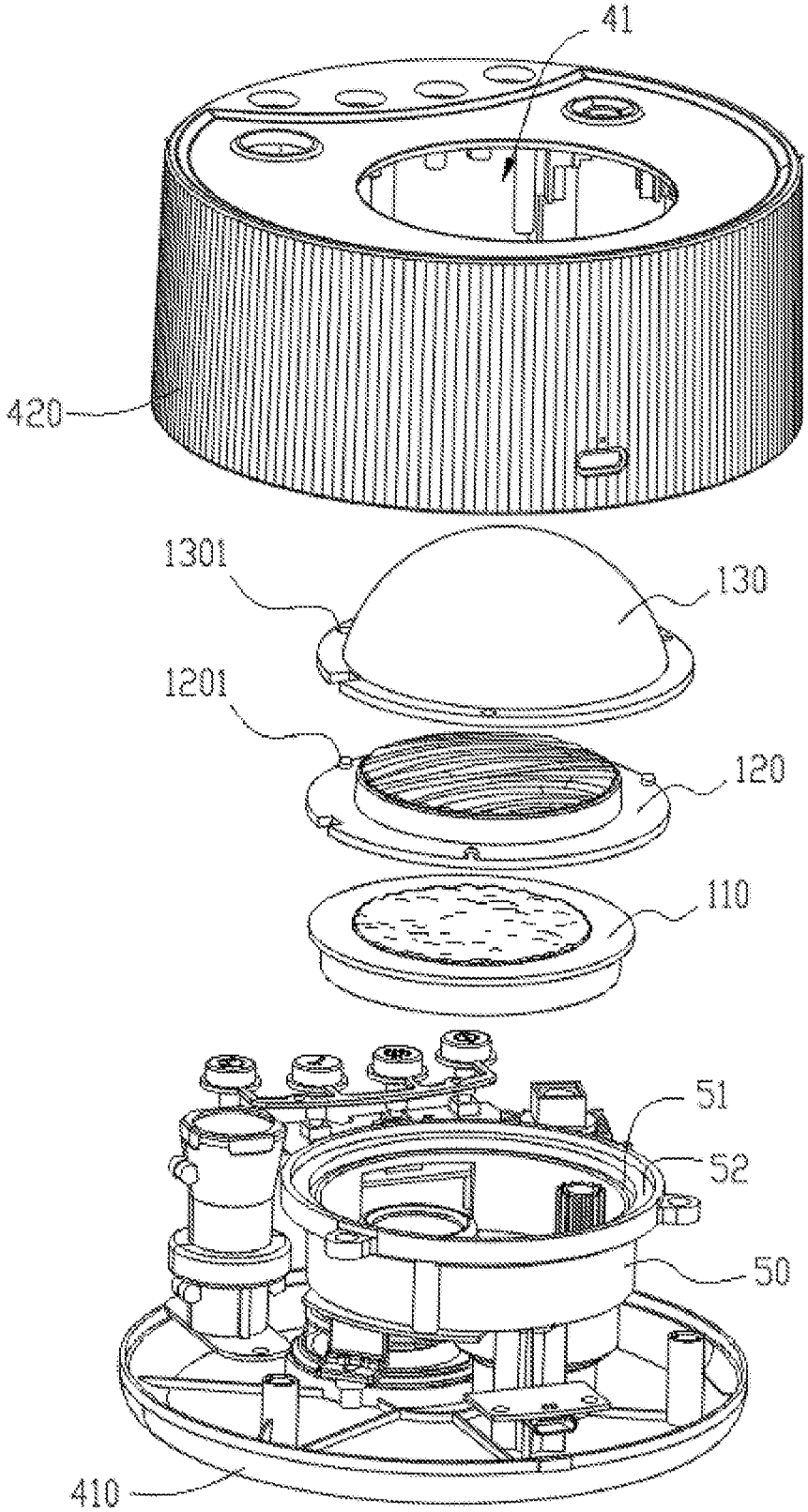
FIG. 13 is an exploded schematic diagram of the projection device according to one embodiment of the present disclosure.
Figure 14:
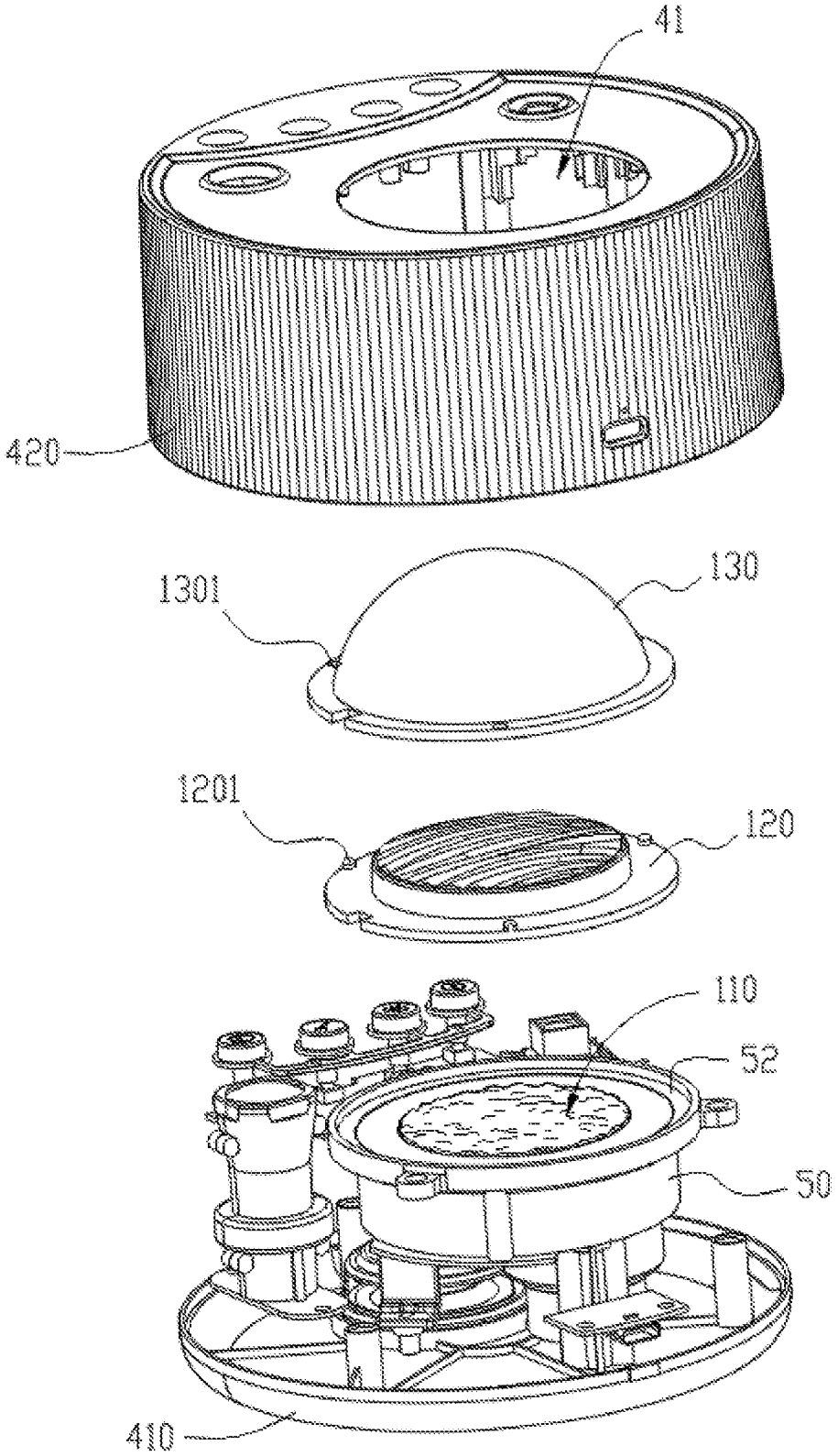
FIG. 14 is another exploded schematic diagram of the projection device according to one embodiment of the present disclosure.
Figure 15:
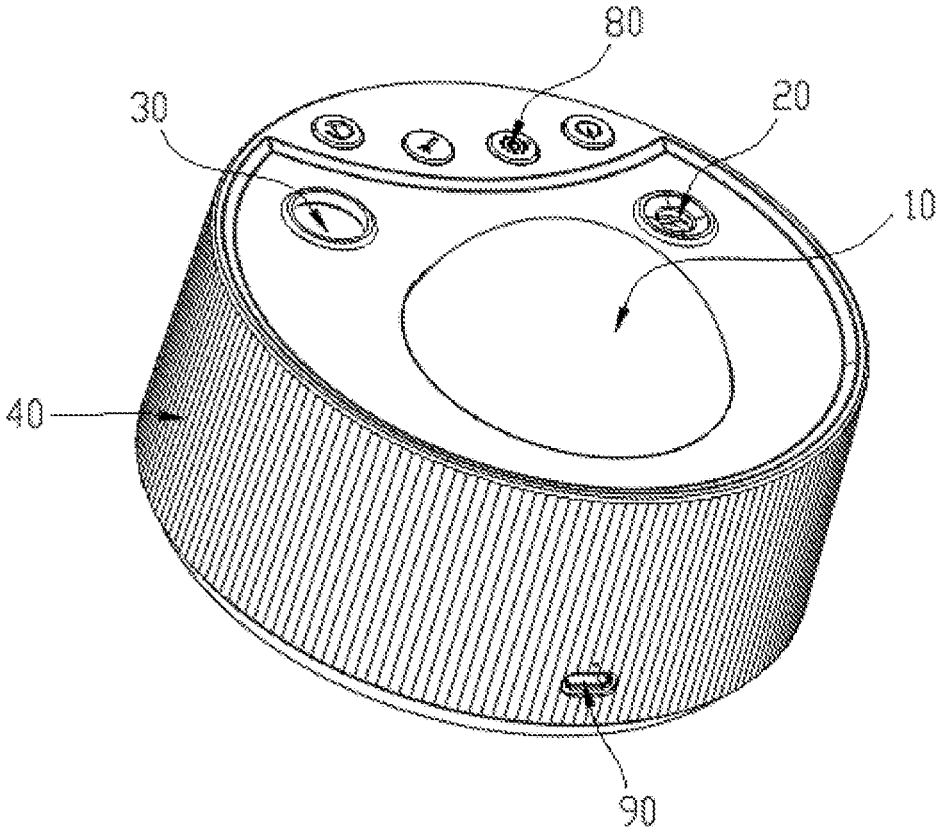
FIG. 15 is a perspective schematic diagram of the projection device according to one embodiment of the present disclosure.
Figure 16:
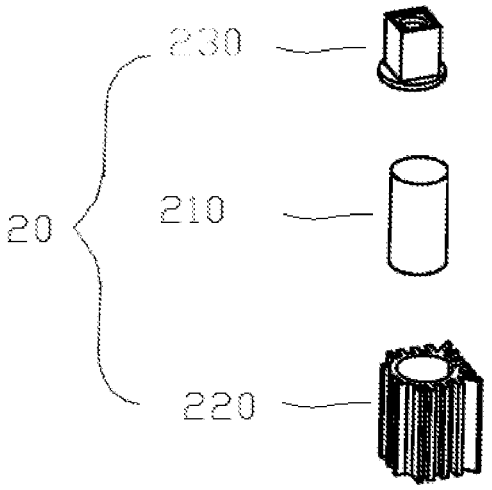
FIG. 16 is an exploded schematic diagram of a second projection assembly according to one embodiment of the present disclosure.
Figure 17:
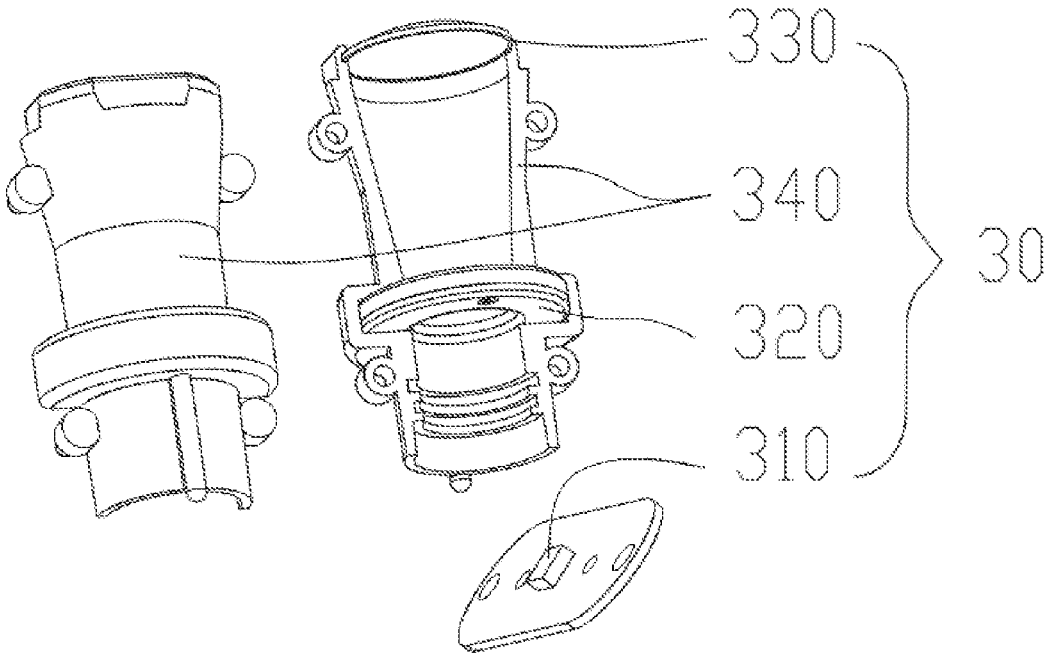
FIG. 17 is an exploded schematic diagram of a third projection assembly according to one embodiment of the present disclosure.
Figure 18:
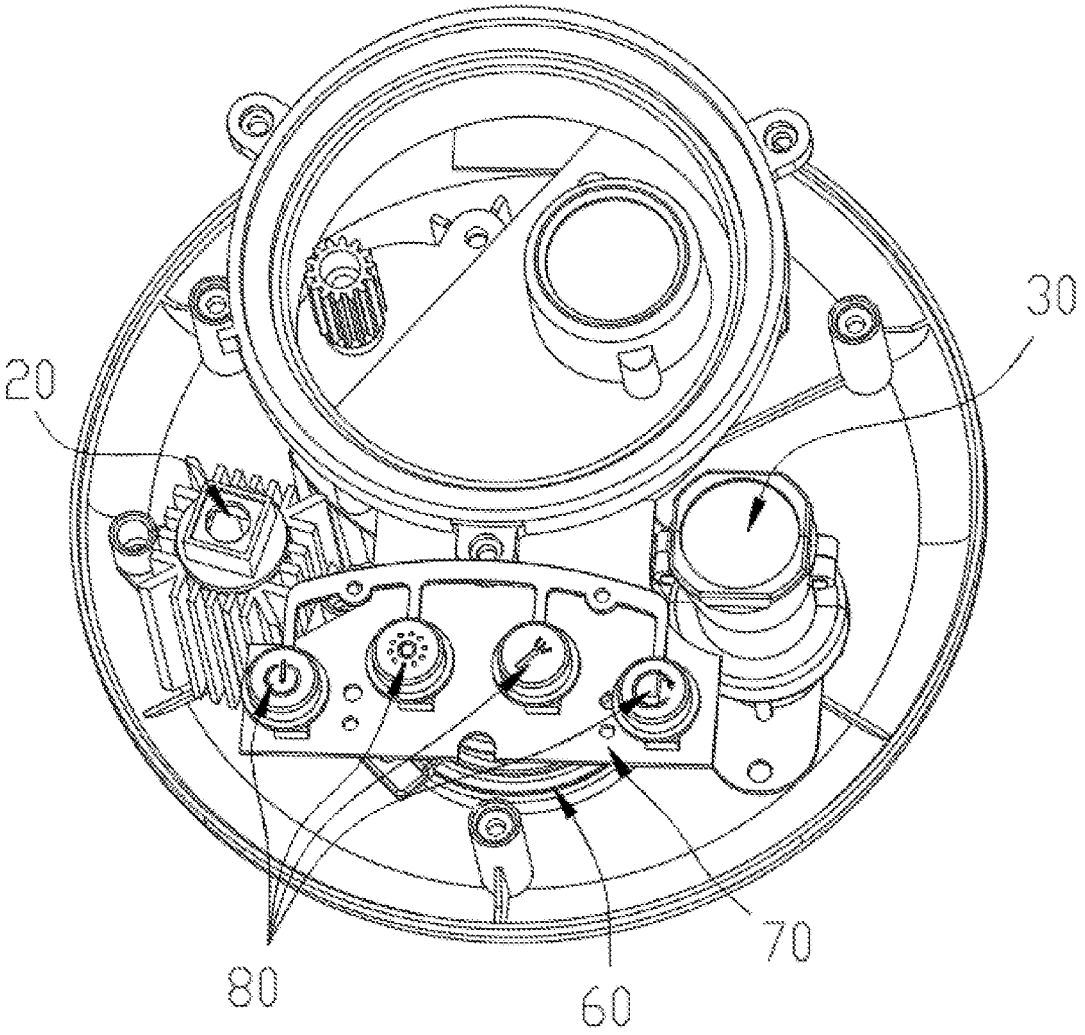
FIG. 18 is a schematic diagram showing an interior structure of the projection device provided with speaker and other interior components according to one embodiment of the present disclosure.

As shown in FIG. 1, the present disclosure provides a projection device. The projection device comprise a first projection assembly 10. The first projection assembly 10 comprises a first light source assembly 100, a first lens 110, a second lens 120, a light-transmitting lampshade 130, and a driving device 140. The first light source assembly 100 comprises a first light source 101 configured to generate projection light. The first lens 110 is arranged on a light path of the first light source 101. A plurality of first irregular plano-convex lenses are arranged on a light exit side of the first lens. The second lens 120 is arranged on the light path of the first light source 101 and is arranged behind the first lens 110. A plurality of second irregular plano-convex lenses are arranged on a light exit side of the second lens 120. Shapes of the plurality of second irregular plano-convex lenses arranged on the light exit side of the second lens are different from shapes of the plurality of first irregular plano-convex lenses arranged on the light exit side of the first lens. The light-transmitting lampshade 130 is arranged on the light path of the first light source 101 and is arranged behind the second lens 120. The projection light generated by the first light source 101 sequentially passes through the first lens 110, the second lens 120, and the light-transmitting lampshade 130 and emits externally. The driving device 140 is connected to the first lens 110. The driving device 140 is configured to drive the first lens 110 to rotate.

In the present disclosure, the first lens 110, the second lens 120, and the light-transmitting lampshade 130 are arranged on the light path of the first light source 101, the plurality of first irregular plano-convex lenses are arranged on the light exit side of the first lens 110 and the plurality of second irregular plano-convex lenses with different shapes from the first plano-convex lenses are arranged on the light exit side of the first lens 120, so when the driving device 140 drives the first lens 110 to rotate, not only a dynamic projection effect is generated, but also a variable projection effect is generated. After the light passes through the first lens and the second lens, different shapes of plano-convex lenses on the first lens and the second lens make projection effects superimposed and then the projection light exits from the light-transmitting lampshade to form the variable projection effect. In other embodiments, the driving device 140 may be connected to the second lens 120 and drives the second lens 120 to rotate. Rotation of the second lens 120 also realize the variable projection effect generated by superimposed projection light exiting from the light-transmitting lampshade that pass through different shapes of plano-convex lenses on the first lens and the second lens.

As shown in FIGS. 2-5, in some embodiments, the first lens 110 comprises a lens portion 111 and a tooth portion 112. The plurality of first irregular plano-convex lenses are arranged in the lens portion 111. Meshing teeth 1121 are arranged on the tooth portion 112. The driving device 140 comprises a motor 141 and a gear 142 directly or indirectly driven by the motor 141. When the motor 141 drives the gear 142 to rotate, the gear 142 drives the light-transmitting lampshade 130 to rotate through the tooth portion 112. For example, the motor 141 is a deceleration motor 141 and the gear 142 is directly mounted on an output shaft of the deceleration motor 141. The motor 141 directly drives the gear 142. Alternatively, the motor 141 indirectly drives the gear 142 through a reduction gear set. Furthermore, the tooth portion 112 is arranged around a periphery of the lens portion 111 and protrudes from an end face of the lens portion 111 to form a ring structure. The meshing teeth 1121 are arranged on an inner side wall or an outer side wall of the ring structure (the tooth portion 112). In other embodiments, the driving device 140 comprises the motor 141 and a belt drive assembly 143 connecting the motor 141 and the first lens 110. The motor 141 drives the first lens 110 to rotate through the belt drive assembly 143. Alternatively, the driving device 140 comprises the motor 141, and the first lens 110 is fixedly mounted on the output shaft of the motor 141.

As shown in FIGS. 4-10, in some embodiments, in order to present the variable projection effect, the plurality of first irregular plano-convex lenses arranged on the light exit side of the first lens 110 are hill-shaped plano-convex lenses 1111. That is, a plurality of hill-shaped undulating lines 1111 with different sizes and shapes are formed on a light exit surface of the first lens 110. The plurality of second irregular plano-convex lenses arranged on the light exit side of the second lens 120 are selected from elongated plano-convex lenses 121, spiral plano-convex lenses 122, and polygonal plano-convex lenses 123. The elongated plano-convex lens 121 may be convex elongated plano-convex lenses 1211 or concave elongated plano-convex lenses 1212. The light emitted from the first lens 110 passes through the second lenses provided with the elongated plano-convex lenses 121 and projects an effect of aurora. The light emitted from the first lens 110 passes through the second lens 120 provided with the spiral plano-convex lenses 122 and projects a vortex effect (similar to an effect of the Milky Way). The light emitted from the first lens 110 passes through the second lens 120 provided with the polygonal plano-convex lenses 123 and projects an effect of water ripples.

As shown in FIGS. 11-15, the projection device further comprises a housing 40 and a mounting frame 50. The housing 40 defines a lampshade hole 41. The mounting frame 50 is arranged in the housing 40. A position of the mounting frame 50 corresponds to a position of the lampshade hole 41. The first lens 110 and the second lens 120 are mounted in the housing 40 through the mounting frame 50. The light-transmitting lampshade 130 is arranged at the lampshade hole 41.

Optionally, the housing 40 comprises a bottom shell 410 and a top shell 420 covered on the bottom shell 410. The light-transmitting lampshade 130 is a hollow hemispherical light-transmitting lampshade. Both of an inner surface of the light-transmitting lampshade 130 and an outer surface of the light-transmitting lampshade 130 are smooth curved surfaces. The second lens 120 is fixedly connected to the light-transmitting lampshade 130.

Optionally, the second lens 120 comprises connecting columns 1201, the light-transmitting lampshade 130 comprises connecting holes 1301 matched with the connecting columns 1201. The connecting columns 1201 are separately inserted into a corresponding connecting hole 1301 during assembly, so to the second lens 120 is fixedly connected to the light-transmitting lampshade 130.

Furthermore, a first step area 51 and a second step area 52 are arranged on one end of the mounting frame 50 close to the lampshade hole 130. The first step area 51 and the second step area 52 are arranged in sequence along a direction away from a center of the mounting frame 50. The first lens 110 is arranged on the first step area 51 and the second lens 120 is arranged on the second step area 52. The first light source 101 is arranged on one side of the first lens 110 away from the second lens 120. The first light source 101 is deviated from a rotation center of the first lens 110. By defining the first step area 51 and the first step area 52 on the mounting frame 50, an interior structure of the projection device is simple and compact on the one hand, and the assembly difficulty is simplified during a production process on the other hand. In addition, after the first lens 110 and the second lens 120 are separately mounted on the first step area 51 and the first step area 52, the first lens 110 is limited in a space enclosed by the second lens 120 and the first step area 51, so a moving range of the first lens 110 is well limited. When the driving device 140 drives the first lens 110 to rotate, the first lens 110 rotates smoothly, so as to ensure a stable projection effect. Optionally, convex ribs 53 are arranged on an end surface of the second lens 120 facing the first lens 110 and are arranged on a surface of the first stepped area 51. When the first lens 110 rotates, the ribs 53 reduce frictional resistance between the first lens 110 and the second lens 120. Since the first lens 110 comprises the plurality of irregular hill-shaped plano-convex lenses 1111 and the first light source 101 is deviated from the rotation center of the first lens 110, so when the first lens 110 rotates, different hill-shaped plano-convex lenses 1111 are rotated to be in front of the outgoing light of the first light source 101, thereby generating diverse projection effects.

Optionally, the first light source assembly 100 further comprises a lamp board 102, a lamp frame 103, and a light concentrating piece 104. The lamp board 102 is mounted on the mounting frame 50. The first light source 101 is an LED lamp bead. The lamp frame 103 is mounted on the lamp board 102 and is arranged on an outside of the LED lamp bead 101. The light concentrating piece 104 is mounted in the lamp frame 103. The light concentrating piece 104 is configured to concentrate light emitted from the LED lamp bead 104. Optionally, the light concentrating piece 104 is a condensing lens or a reflector, and the LED lamp bead is a RGB lamp bead.

As shown in FIGS. 15-18, the projection device further comprises a second projection assembly 20 and a third projection assembly 30. The second projection assembly 20 comprises a second light source 210 configured to generate laser light, a heat dissipating bracket 220 mounted outside the second light source 210, and a grating sheet arranged in a laser light exit direction of the second light source 210 (the grating sheet is mounted on a grating sheet holder 230). The third projection assembly 30 comprises a third light source 310, a film 320 with a pattern, a convex lens 330 configured to magnify a projected pattern, and a lens holder 340 configured to mount the film 320 and the convex lens 330.

The laser light emitted by the second light source 210 generates diffraction spots after passing through the grating sheet, and projects an effect of stars. Light emitted by the third light source 310 passes through the film 320 and the convex lens 330 and projects an effect of the pattern on the film 320.

For example, the pattern of the moon or the earth may be printed on the film 320, so that the effect of the moon or the earth is projected. By arranging the second projection assembly 20 and the third projection assembly 30, the projection device of the embodiment projects a variety of projection effects including stars, aurora (the Milky Way, or water ripples, etc.) and the moon (or the earth) at the same time. Moreover, when the first lens 110 rotates, the effect of the aurora (the Milky Way, or the water ripples, etc.) is a dynamically changing effect. Furthermore, in order to provide power to the relevant light sources and the motor 141, in the embodiment, a rechargeable battery is arranged in the housing 40 of the projection device, or a power supply interface 90 configured to connect with an external power supply is arranged on the housing 40. In order to enrich functions of the projection device, speaker 60, circuit board 70, function buttons 80, and other components are arranged in the housing 40.

Embodiment 2

Figure 19:
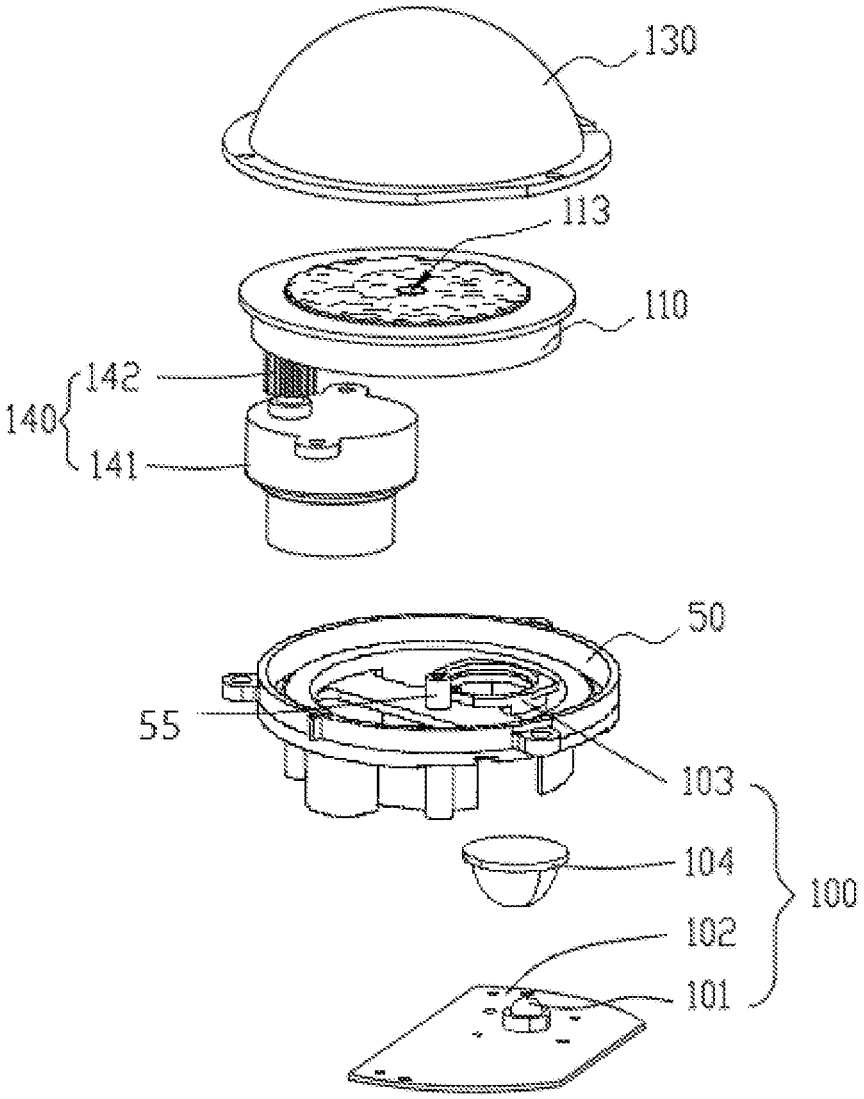
FIG. 19 is an exploded schematic diagram of the first projection assembly according to another embodiment of the present disclosure where the light-transmitting lampshade is a hollow hemispherical light-transmitting lampshade.
Figure 20:
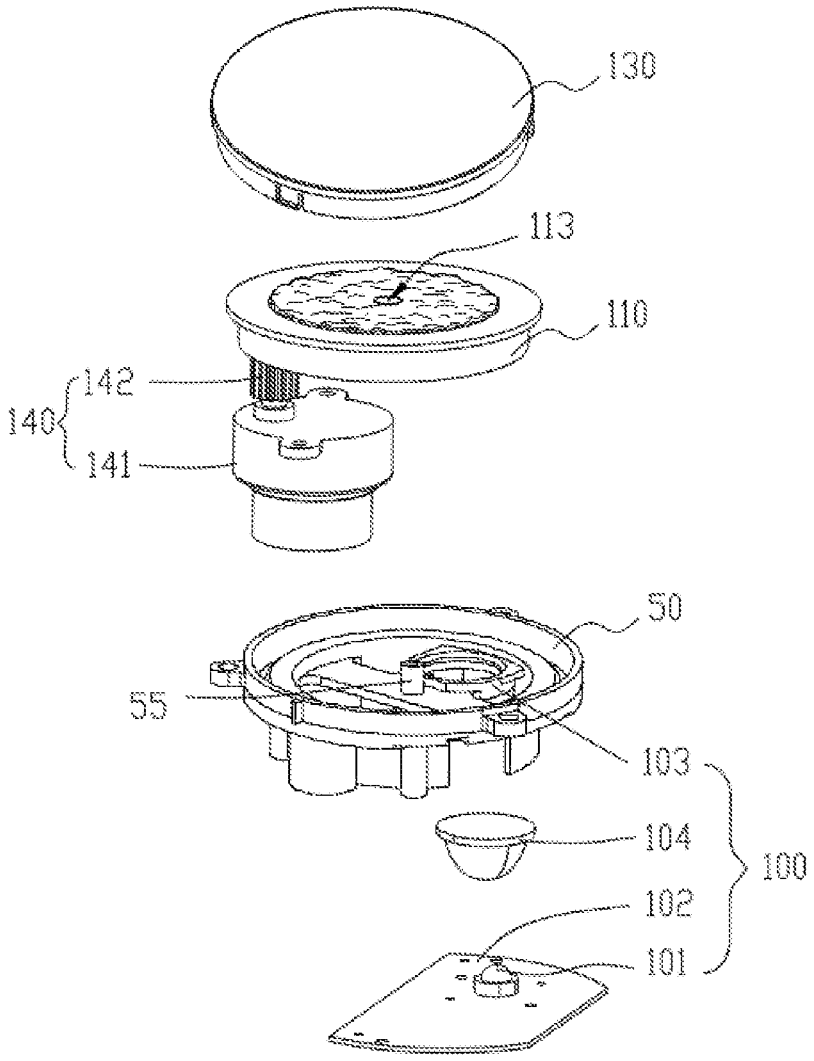
FIG. 20 is an exploded schematic diagram of the first projection assembly according to another embodiment of the present disclosure where the light-transmitting lampshade is a disc-shaped light-transmitting lampshade.

As shown in FIG. 19, the present disclosure further provides a projection device. The projection device comprises a first projection assembly 10. The first projection assembly 10 comprises a first light source assembly 100, a first lens 110, a driving device 140, and a light-transmitting lampshade 130. The first light source assembly 100 comprises a first light source 101 configured to generate projection light. The first lens 110 is arranged on a light path of the first light source 101. A plurality of first irregular plano-convex lenses are arranged on the first lens 110. Optionally, the plurality of first irregular plano-convex lenses are arranged on a light exit side of the first lens 110. The light-transmitting lampshade 130 is arranged on the light path of the first light source 101 and is arranged behind the first lens 110. The projection light generated by the first light source 101 sequentially passes through the first lens 110 and the light-transmitting lampshade 130 and emits externally. The driving device 140 is connected to the first lens 110. The driving device 140 is configured to drive the first lens 110 to rotate. The light-transmitting lampshade comprises a plurality of second irregular plano-convex lenses.

In the present disclosure, the first lens 110 and the light-transmitting lampshade 130 are arranged on the light path of the first light source 101, the plurality of first irregular plano-convex lenses are arranged on the light exit side of the first lens 110 and a plurality of second irregular plano-convex lenses with different shapes from the first plano-convex lenses are arranged on the light-transmitting lampshade 130, so when the driving device 140 drives the first lens 110 to rotate, not only a dynamic projection effect is generated, but also a variable projection effect is generated. After the light passes through the first lens and the light-transmitting lampshade 130, different shapes of plano-convex lenses on the first lens and the light-transmitting lampshade 130 make projection effects superimposed and then the projection light exits from the light-transmitting lampshade to form the variable projection effect.

As shown in FIGS. 2-5, in some embodiments, the first lens 110 comprises a lens portion 111 and a tooth portion 112. The plurality of first irregular plano-convex lenses are arranged in the lens portion 111. Meshing teeth 1121 are arranged on the tooth portion 112. The driving device 140 comprises a motor 141 and a gear 142 directly or indirectly driven by the motor 141. When the motor 141 drives the gear 142 to rotate, the gear 142 drives the light-transmitting lampshade 130 to rotate through the tooth portion 112. For example, the motor 141 is a deceleration motor 141 and the gear 142 is directly mounted on an output shaft of the deceleration motor 141. The motor 141 directly drives the gear 142. Alternatively, the motor 141 indirectly drives the gear 142 through a reduction gear set. Furthermore, the tooth portion 112 is arranged around a periphery of the lens portion 111 and protrudes from an end face of the lens portion 111 to form a ring structure. The meshing teeth 1121 are arranged on an inner side wall or an outer side wall of the ring structure (the tooth portion 112). In other embodiments, the driving device 140 comprises the motor 141 and a belt drive assembly 143 connecting the motor 141 and the first lens 110. The motor 141 drives the first lens 110 to rotate through the belt drive assembly 143. Alternatively, the driving device 140 comprises the motor 141, and the first lens 110 is fixedly mounted on the output shaft of the motor 141.

As shown in FIGS. 6 and 21-24, in some embodiments, in order to present the variable projection effect, the plurality of first irregular plano-convex lenses arranged on the light exit side of the first lens 110 are hill-shaped plano-convex lenses 1111. That is, a plurality of hill-shaped undulating lines 1111 with different sizes and shapes are formed on a light exit surface of the first lens 110. The plurality of second irregular plano-convex lenses arranged on the light-transmitting lampshade 130 are selected from one or combination of elongated plano-convex lenses 131, spiral plano-convex lenses 132, and polygonal plano-convex lenses 133. The elongated plano-convex lens 131 may be convex elongated plano-convex lenses or concave elongated plano-convex lenses. The light emitted from the first lens 110 passes through the light-transmitting lampshade 130 provided with the elongated plano-convex lenses 131 and projects an effect of aurora. The light emitted from the first lens 110 passes through the light-transmitting lampshade 130 provided with the spiral plano-convex lenses 132 and projects a vortex effect (similar to an effect of the Milky Way). The light emitted from the first lens 110 passes through the light-transmitting lampshade 130 provided with the polygonal plano-convex lenses 133 and projects an effect of water ripples.

Figure 21:
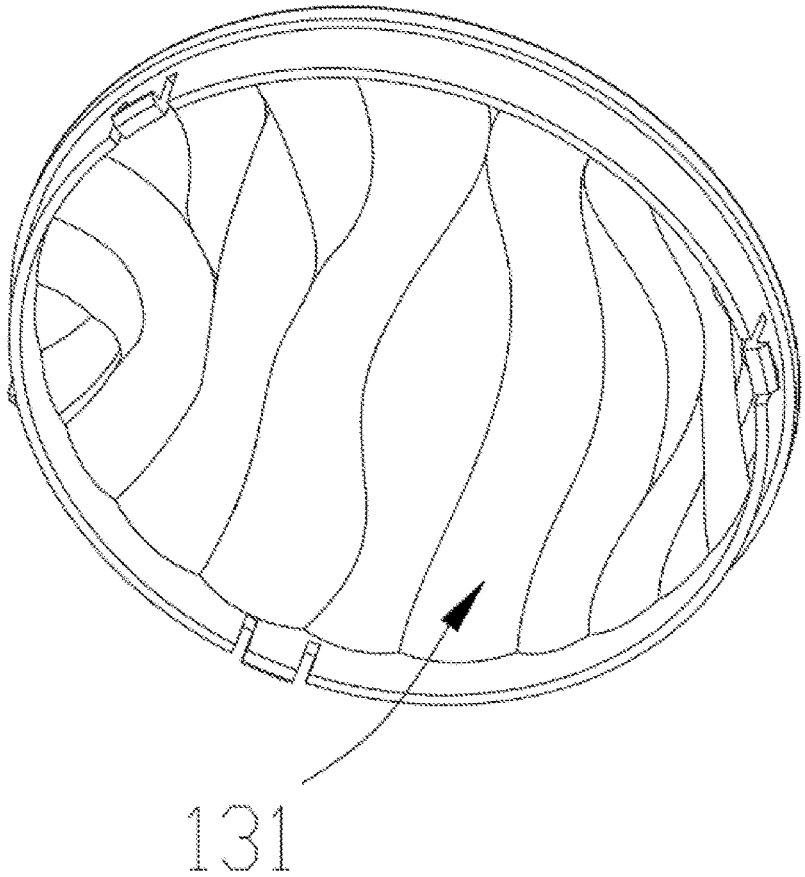
FIG. 21 is a schematic structural diagram of the disc-shaped light-transmitting lampshade provided with elongated plano-convex lenses according to one embodiment of the present disclosure.
Figure 22:
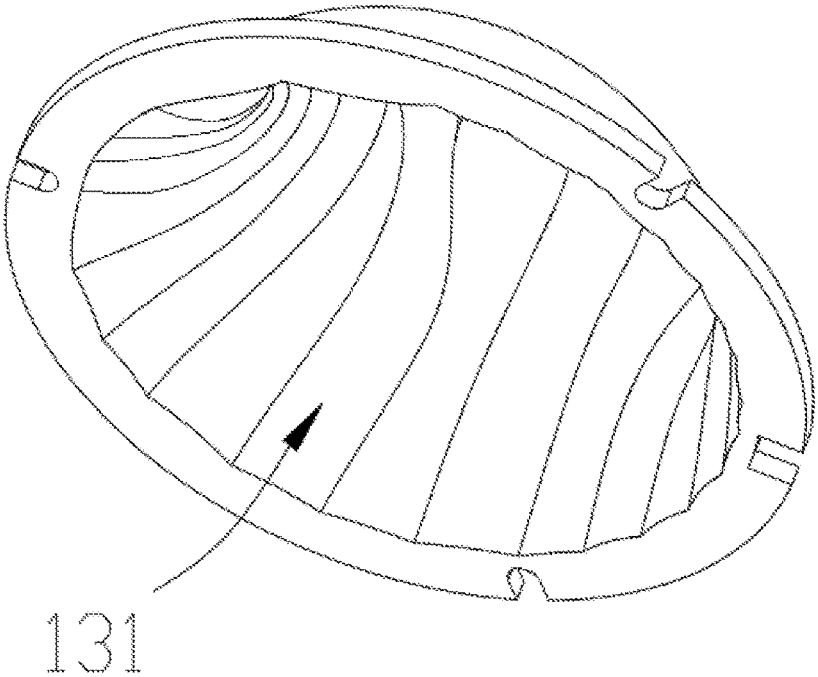
FIG. 22 is a schematic diagram of the hollow hemispherical light-transmitting lampshade provided with protruding elongated plano-convex lenses according to another embodiment of the present disclosure.
Figure 23:
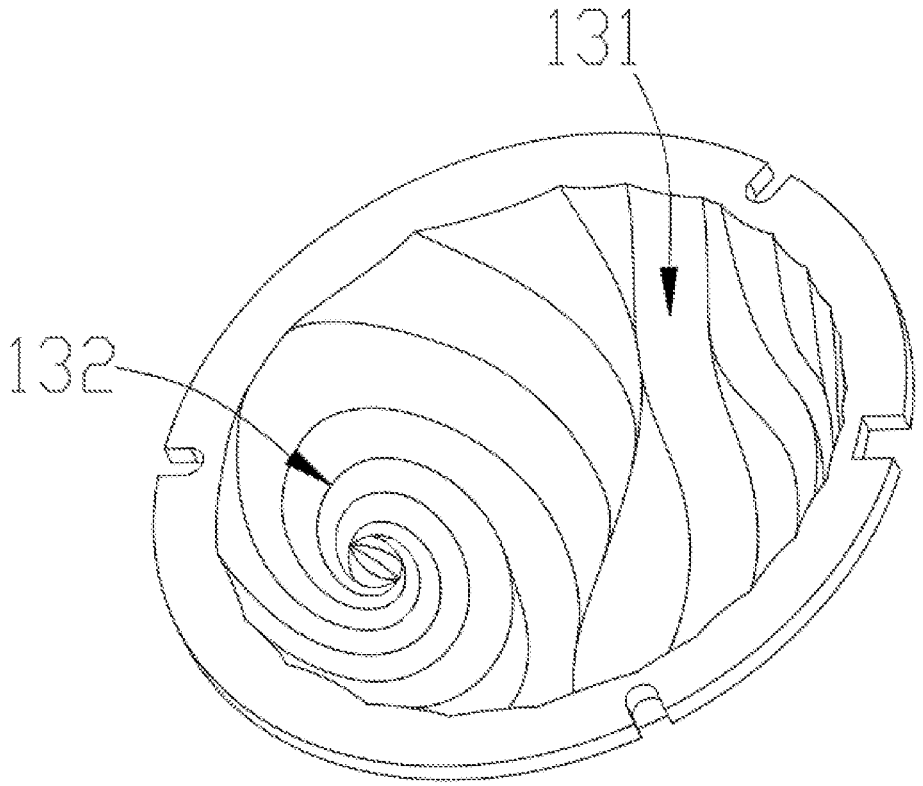
FIG. 23 is a schematic diagram of the hollow hemispherical light-transmitting lampshade provided with concave elongated plano-convex lenses and spiral plano-convex lenses according to another embodiment of the present disclosure.
Figure 24:
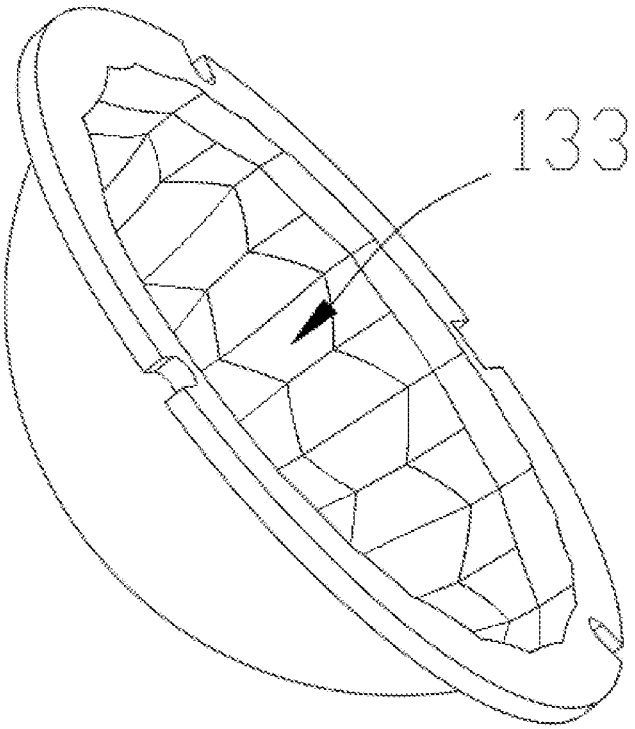
FIG. 24 is a schematic diagram of the hollow hemispherical light-transmitting lampshade provided with polygonal plano-convex lenses according to another embodiment of the present disclosure.
Figure 25:
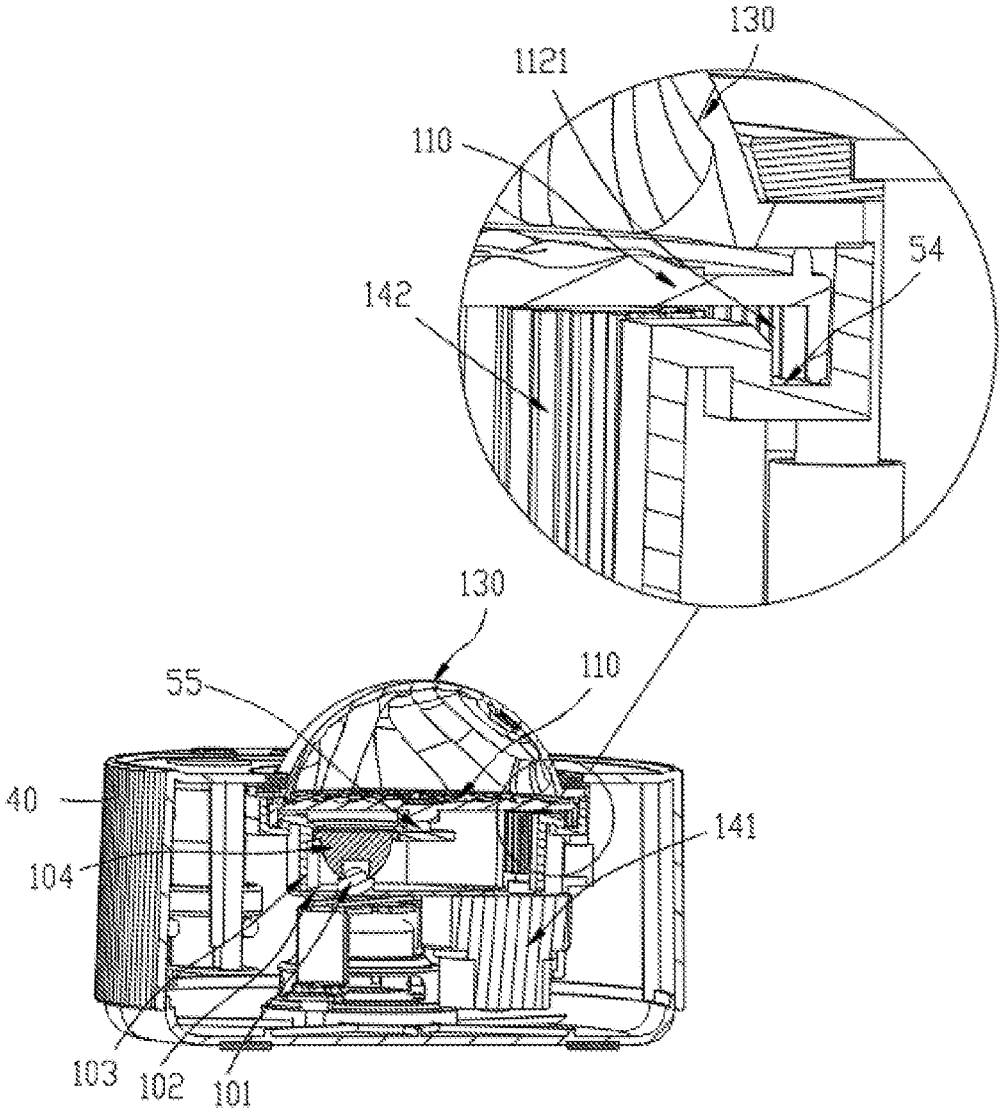
FIG. 25 is a cross-sectional schematic diagram of the projection device according to another embodiment of the present disclosure.
Figure 26:
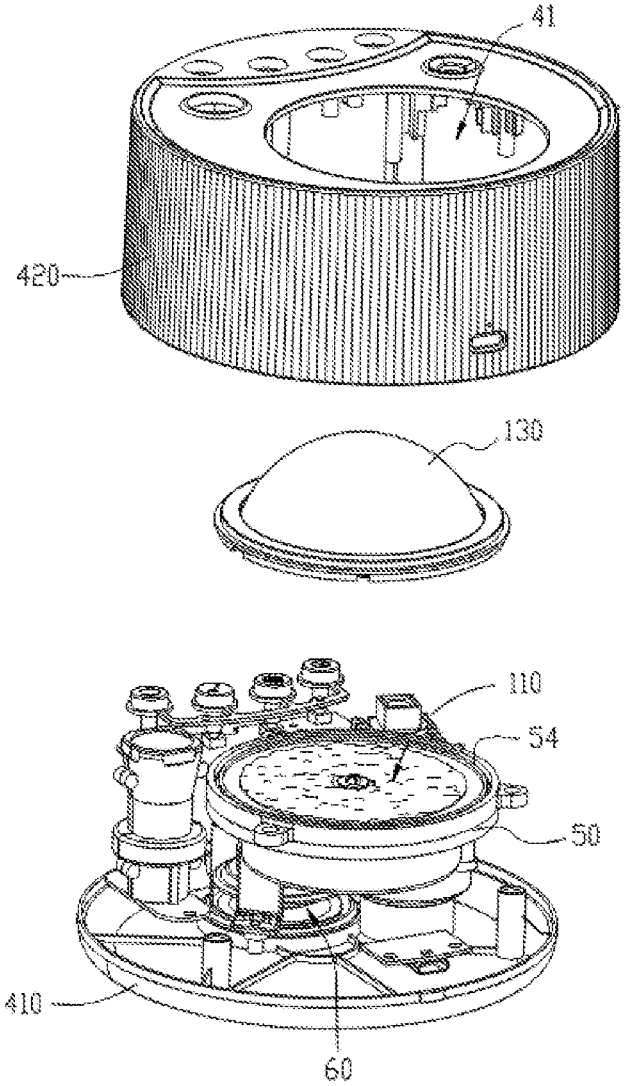
FIG. 26 is an exploded schematic diagram of the projection device according to another embodiment of the present disclosure.
Figure 27:
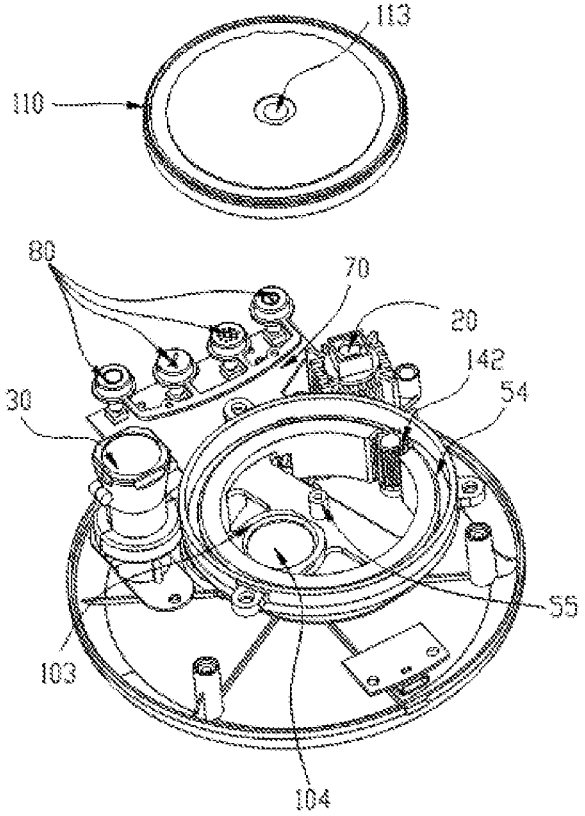
FIG. 27 is a schematic diagram of the first lens and the mounting frame according to another embodiment of the present disclosure.
Figure 28:
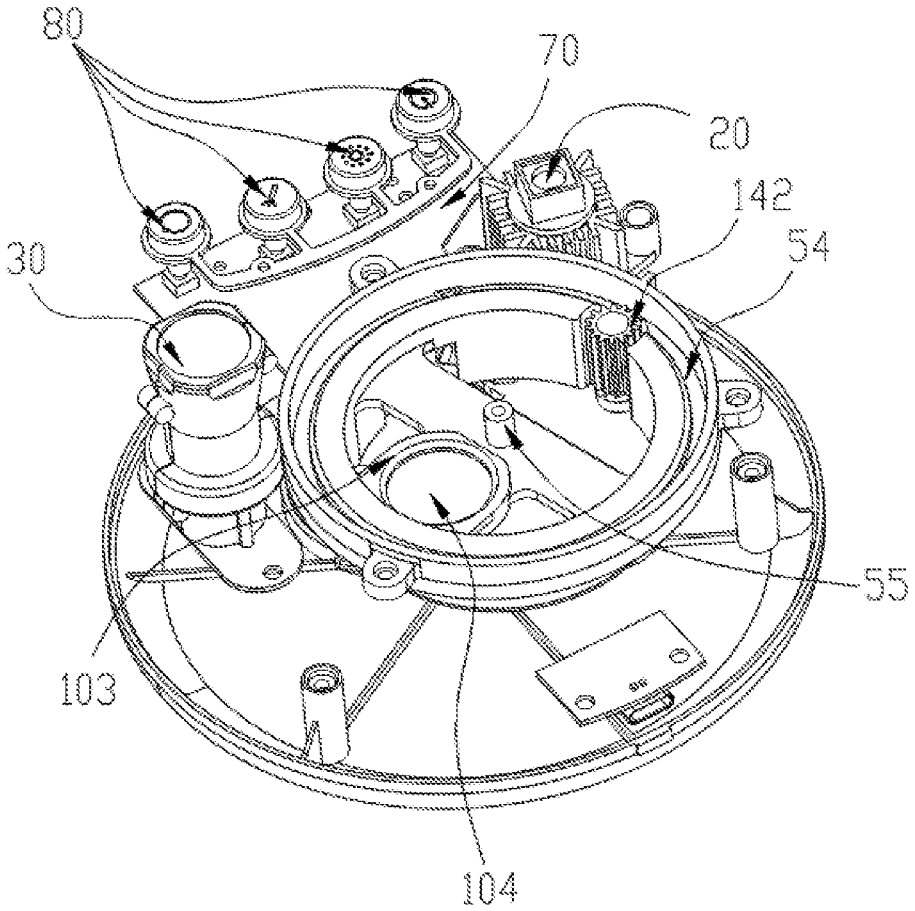
FIG. 28 is a schematic diagram of an interior of the projection device with the second projection assembly and the third projection assembly according to another embodiment of the present disclosure.

As shown in FIGS. 19-26, the projection device further comprises a housing 40 and a mounting frame 50. The housing 40 defines a lampshade hole 41. The mounting frame 50 is arranged in the housing 40. A position of the mounting frame 50 corresponds to a position of the lampshade hole 41. The first lens 110 is mounted in the housing 40 through the mounting frame 50. The light-transmitting lampshade 130 is arranged at the lampshade hole 41. Optionally, the housing 40 comprises a bottom shell 410 and a top shell 420 covered on the bottom shell 410. The light-transmitting lampshade 130 is a hollow hemispherical light-transmitting lampshade An outer surface of the light-transmitting lampshade 130 is a smooth curved surface. The plurality of second irregular plano-convex lenses 131/132/133 are arranged on an inner surface of the light-transmitting lampshade 130. In some embodiments, the light-transmitting lampshade 130 is a disc-shapes light-transmitting lampshade (as shown in FIG. 21). An outer surface of the disc-shaped light-transmitting lampshade 130 is a smooth plane. A plurality of second irregular plano-convex lenses 131 are arranged on an inner surface of the disc-shaped light-transmitting lampshade 130. In some embodiments, a rotating shaft 55 is arranged on a center of the mounting frame 50. A shaft hole 113 is on a center of the first lens 110. The rotating shaft 55 passes through the shaft hole 113, so the first lens 110 is rotatably connected with the mounting frame 50.

In some embodiments, a step area 54 is arranged on one end of the mounting frame 50 close to the lampshade hole 130. The first lens 110 is arranged on the step area 54. The first light source 101 is arranged on one side of the first lens 110 away from the light-transmitting lampshade 130. The first light source 101 is deviated from a rotation center of the first lens 110. By defining the step area 54 on the mounting frame 50, an interior structure of the projection device is simple and compact on the one hand, and the assembly difficulty is simplified during a production process on the other hand. In addition, after the first lens 110 is mounted on the step area 54, the first lens 110 is limited in a space enclosed by the light-transmitting lampshade 130 and the step area 54, so a moving range of the first lens 110 is well limited. When the driving device 140 drives the first lens 110 to rotate, the first lens 110 rotates smoothly, so as to ensure a stable projection effect. Since the first lens 110 comprises the plurality of irregular hill-shaped plano-convex lenses 1111 and the first light source 101 is deviated from the rotation center of the first lens 110, so when the first lens 110 rotates, different hill-shaped plano-convex lenses 1111 are rotated to be in front of the outgoing light of the first light source 101, thereby generating diverse projection effects.

Optionally, the first light source assembly 100 further comprises a lamp board 102, a lamp frame 103, and a light concentrating piece 104. The lamp board 102 is mounted on the mounting frame 50. The first light source 101 is an LED lamp bead. The lamp frame 103 is mounted on the lamp board 102 and is arranged on an outside of the LED lamp bead 101. The light concentrating piece 104 is mounted in the lamp frame 103. The light concentrating piece 104 is configured to concentrate light emitted from the LED lamp bead 104. Optionally, the light concentrating piece 104 is a condensing lens or a reflector, and the LED lamp bead is a RGB lamp bead.

As shown in FIGS. 16-18 and 28, the projection device further comprises a second projection assembly 20 and a third projection assembly 30. The second projection assembly 20 comprises a second light source 210 configured to generate laser light, a heat dissipating bracket 220 mounted outside the second light source 210, and a grating sheet arranged in a laser light exit direction of the second light source 210 (the grating sheet is mounted on a grating sheet holder 230). The third projection assembly 30 comprises a third light source 310, a film 320 with a pattern, a convex lens 330 configured to magnify a projected pattern, and a lens holder 340 configured to mount the film 320 and the convex lens 330. The laser light emitted by the second light source 210 generates diffraction spots after passing through the grating sheet, and projects an effect of stars. Light emitted by the third light source 310 passes through the film 320 and the convex lens 330 and projects an effect of the pattern on the film 320.

For example, the pattern of the moon or the earth may be printed on the film 320, so that the effect of the moon or the earth is projected. By arranging the second projection assembly 20 and the third projection assembly 30, the projection device of the embodiment projects a variety of projection effects including stars, aurora (the Milky Way, or water ripples, etc.) and the moon (or the earth) at the same time. Moreover, when the first lens 110 rotates, the effect of the aurora (the Milky Way, or the water ripples, etc.) is a dynamically changing effect. Furthermore, in order to provide power to the relevant light sources and the motor 141, in the embodiment, a rechargeable battery is arranged in the housing 40 of the projection device, or a power supply interface 90 configured to connect with an external power supply is arranged on the housing 40. In order to enrich functions of the projection device, speaker 60, circuit board 70, function buttons 80, and other components are arranged in the housing 40.

Foregoing descriptions are only optional embodiments of the present disclosure and are not intended to limit the present disclosure. Any modification, equivalent replacement, or improvement within the technical scope of the present disclosure should be included in the protection scope of the present disclosure.

What is claimed is:

1. A projection device, comprising: a first projection assembly; wherein the first projection assembly comprises a first light source assembly, a first lens, a second lens, a light-transmitting lampshade, and a driving device;

wherein the first light source assembly comprises a first light source configured to generate projection light;

wherein the first lens is arranged on a light path of the first light source; a plurality of first irregular plano-convex lenses are arranged on a light exit side of the first lens;

wherein the second lens is arranged on the light path of the first light source and is arranged behind the first lens; a plurality of second irregular plano-convex lenses are arranged on a light exit side of the second lens; shapes of the plurality of second irregular plano-convex lenses arranged on the light exit side of the second lens are different from shapes of the plurality of first irregular plano-convex lenses arranged on the light exit side of the first lens;

wherein the light-transmitting lampshade is arranged on the light path of the first light source and is arranged behind the second lens; the projection light generated by the first light source sequentially passes through the first lens, the second lens, and the light-transmitting lampshade and emits externally;

wherein the driving device is connected to the first lens or the second lens; the driving device is configured to drive the first lens or the second lens to rotate.

2. The projection device according to claim 1, wherein the first lens comprises a lens portion and a tooth portion; the plurality of first irregular plano-convex lenses are arranged in the lens portion; meshing teeth are arranged on the tooth portion; the driving device comprises a motor and a gear directly or indirectly driven by the motor; when the motor drives the gear to rotate, the gear drives the light-transmitting lampshade to rotate through the tooth portion.

3. The projection device according to claim 1, wherein the driving device comprises a motor and a belt drive assembly connecting the motor and the first lens; the motor drives the first lens to rotate through the belt drive assembly.

4. The projection device according to claim 1, wherein the plurality of first irregular plano-convex lenses arranged on the light exit side of the first lens are hill-shaped plano-convex lenses; the plurality of second irregular plano-convex lenses arranged on the light exit side of the second lens are selected from elongated plano-convex lenses, spiral plano-convex lenses, and polygonal plano-convex lenses.

5. The projection device according to claim 1, wherein the light-transmitting lampshade is a hollow hemispherical light-transmitting lampshade; both of an inner surface of the light-transmitting lampshade and an outer surface of the light-transmitting lampshade are smooth curved surfaces; the second lens is fixedly connected to the light-transmitting lampshade.

6. The projection device according to claim 1, wherein the projection device further comprises a housing and a mounting frame; the housing defines a lampshade hole; the mounting frame is arranged in the housing; a position of the mounting frame corresponds to a position of the lampshade hole; the first lens and the second lens are mounted in the housing through the mounting frame; the light-transmitting lampshade is arranged at the lampshade hole.

7. The projection device according to claim 1, wherein the projection device further comprises a second projection assembly and a third projection assembly;

wherein the second projection assembly comprises a second light source configured to generate laser light, a heat dissipating bracket mounted outside the second light source, and a grating sheet arranged in a laser light exit direction of the second light source;

wherein the third projection assembly comprises a third light source, a film with a pattern, a convex lens configured to magnify a projected pattern, and a lens holder configured to mount the film and the convex lens.

8. The projection device according to claim 2, wherein the tooth portion is arranged around a periphery of the lens portion and protrudes from an end face of the lens portion; the meshing teeth are arranged on an inner side wall or an outer side wall of the tooth portion.

9. The projection device according to claim 6, wherein a first step area and a second step area are arranged on one end of the mounting frame close to the lampshade hole; the first step area and the second step area are arranged in sequence along a direction away from a center of the mounting frame; the first lens is arranged on the first step area and the second lens is arranged on the second step area; the first light source is arranged on one side of the first lens away from the second lens; the first light source is deviated from a rotation center of the first lens.

10. The projection device according to claim 9, wherein the first light source assembly further comprises a lamp board, a lamp frame, and a light concentrating piece; the lamp board is mounted on the mounting frame; the first light source is an LED lamp bead; the lamp frame is mounted on the lamp board and is arranged on an outside of the LED lamp bead; the light concentrating piece is mounted in the lamp frame; the light concentrating piece is configured to concentrate light emitted from the LED lamp bead.

11. A projection device, comprising: a first projection assembly;

wherein the first projection assembly comprises a first light source assembly, a first lens, a driving device, and a light-transmitting lampshade;

wherein the first light source assembly comprises a first light source configured to generate projection light;

wherein the first lens is arranged on a light path of the first light source; a plurality of first irregular plano-convex lenses are arranged on the first lens;

wherein the driving device is connected to the first lens; the driving device is configured to drive the first lens to rotate;

wherein the light-transmitting lampshade is arranged on the light path of the first light source and is arranged behind the first lens; the projection light generated by the first light source sequentially passes through the first lens and the light-transmitting lampshade and emits externally;

wherein the light-transmitting lampshade comprises a plurality of second irregular plano-convex lenses, and shapes of the plurality of second irregular plano-convex lenses arranged on the light-transmitting lampshade are different from shapes of the plurality of first irregular plano-convex lenses arranged on the first lens;

wherein the first lens comprises a lens portion and a tooth portion; the plurality of first irregular plano-convex lenses are arranged in the lens portion; meshing teeth are arranged on the tooth portion; the driving device comprises a motor and a gear directly or indirectly driven by the motor; when the motor drives the gear to rotate, the gear drives the light-transmitting lampshade to rotate through the tooth portion.

12. The projection device according to claim 11, wherein the plurality of first irregular plano-convex lenses arranged on the first lens are hill-shaped plano-convex lenses; the plurality of second irregular plano-convex lenses are arranged on an inner surface of the light-transmitting lampshade; the plurality of second irregular plano-convex lenses are selected from one or a combination of elongated plano-convex lenses, spiral plano-convex lenses, and polygonal plano-convex lenses.

13. The projection device according to claim 11, wherein the tooth portion is arranged around a periphery of the lens portion and protrudes from an end face of the lens portion; the meshing teeth are arranged on an inner side wall or an outer side wall of the tooth portion.

14. The projection device according to claim 11, wherein the driving device comprises a motor and a belt drive assembly connecting the motor and the first lens; the motor drives the first lens to rotate through the belt drive assembly.

15. The projection device according to claim 11, wherein the projection device further comprises a housing and a mounting frame; the housing defines a lampshade hole; the mounting frame is arranged in the housing; a position of the mounting frame corresponds to a position of the lampshade hole; the first lens and a second lens are mounted in the housing through the mounting frame; the light-transmitting lampshade is arranged at the lampshade hole.

16. The projection device according to claim 11, wherein the projection device further comprises a second projection assembly and a third projection assembly;

wherein the second projection assembly comprises a second light source configured to generate laser light, a heat dissipating bracket mounted outside the second light source, and a grating sheet arranged in a laser light exit direction of the second light source;

wherein the third projection assembly comprises a third light source, a film with a pattern, a convex lens configured to magnify a projected pattern, and a lens holder configured to mount the film and the convex lens.

17. The projection device according to claim 15, wherein a rotating shaft is arranged on a center of the mounting frame; a shaft hole is on a center of the first lens; the rotating shaft passes through the shaft hole, so the first lens is rotatably connected with the mounting frame.

18. The projection device according to claim 15, wherein a step area is arranged on one end of the mounting frame close to the lampshade hole; the first lens is arranged on the step area and the second lens is arranged on a second step area; the first light source is arranged on one side of the first lens away from the light-transmitting lampshade; the first light source is deviated from a rotation center of the first lens.

19. The projection device according to claim 18, wherein the first light source assembly further comprises a lamp board, a lamp frame, and a light concentrating piece; the lamp board is mounted on the mounting frame; the first light source is an LED lamp bead; the lamp frame is mounted on the lamp board and is arranged on an outside of the LED lamp bead; the light concentrating piece is mounted in the lamp frame; the light concentrating piece is configured to concentrate light emitted from the LED lamp bead.

20. A projection device, comprising: a first projection assembly; wherein the first projection assembly comprises a first light source assembly, a first lens, a driving device, and a light-transmitting lampshade;

wherein the first light source assembly comprises a first light source configured to generate projection light;

wherein the first lens is arranged on a light path of the first light source; a plurality of first irregular plano-convex lenses are arranged on the first lens;

wherein the driving device is connected to the first lens; the driving device is configured to drive the first lens to rotate;

wherein the light-transmitting lampshade is arranged on the light path of the first light source and is arranged behind the first lens; the projection light generated by the first light source sequentially passes through the first lens and the light-transmitting lampshade and emits externally;

wherein the light-transmitting lampshade comprises a plurality of second irregular plano-convex lenses, and shapes of the plurality of second irregular plano-convex lenses arranged on the light-transmitting lampshade are different from shapes of the plurality of first irregular plano-convex lenses arranged on the first lens;

wherein the driving device comprises a motor and a belt drive assembly connecting the motor and the first lens; the motor drives the first lens to rotate through the belt drive assembly.

* * * * *